US007156697B2

(12) United States Patent
Drescher

(10) Patent No.: US 7,156,697 B2
(45) Date of Patent: Jan. 2, 2007

(54) SEALED ELECTRICAL CONNECTOR

(75) Inventor: Thomas Drescher, Hueckeswagen (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/035,600

(22) Filed: Jan. 14, 2005

(65) Prior Publication Data

US 2005/0159046 A1 Jul. 21, 2005

(30) Foreign Application Priority Data

Jan. 16, 2004 (EP) ..... 04000887

(51) Int. Cl.
*H01R 13/40* (2006.01)

(52) U.S. Cl. ..... 439/587

(58) Field of Classification Search ..... 439/587, 439/589, 140–141, 752, 598, 273–275, 279, 439/595, 271

See application file for complete search history.

(56) References Cited

U.S. PATENT DOCUMENTS 5,931,699 A 8/1999 Saito
6,257,928 B1 * 7/2001 Murakami et al. ..... 439/587
6,896,531 B1 * 5/2005 Bakker et al. ..... 439/140
2002/0052142 A1 5/2002 Ishikawa et al.
2002/0127912 A1 * 9/2002 Hamai et al. ..... 439/587

FOREIGN PATENT DOCUMENTS

EP 1 204 174 5/2002

* cited by examiner

*Primary Examiner*—J. F. Duverne
(74) *Attorney, Agent, or Firm*—David P. Wood

(57) ABSTRACT

An electrical connector comprises at least one chamber for accommodating at least one electrical contact and a seal arranged in the inlet region of the chamber through which the electrical contact is plugged through or pierced through when fitting the connector. Immediately behind and/or immediately in front of the seal viewed in the contact plug-in direction an admission region widened transversely to the contact plug-in direction is provided in each case for the sealing material displaced when the contact is plugged through or pulled out.

15 Claims, 3 Drawing Sheets

SEALED ELECTRICAL CONNECTOR

TECHNICAL FIELD

The invention relates to an electrical connector having at least one chamber for accommodating at least one electrical contact and a seal arranged in the inlet region of the chamber through which the electrical contact is plugged or pierced when fitting the connector.

BACKGROUND OF THE INVENTION

In the conventional electrical connectors of this type the sealing material to be displaced when fitting the connector, ie when inserting the electrical contacts into the associated chamber, is carried through into the chamber in question which entails relatively high plugging forces and can result in damage to or even destruction of the seal which is equivalent to a failure of the connector in question. The high plugging forces also give rise inter alia to the risk that the leads provided with the contacts become slightly kinked and the contacts can no longer be properly plugged in when establishing the desired electrical connection in question. Due to the fact that when plugging a particular contact into the associated chamber the seal is crushed in the region of the edge on the inlet side and of the wall of the chamber and can be correspondingly destroyed, water can penetrate into the chamber in question as a result of which the serviceability of the connector is at least greatly impaired. Also when the electrical contacts are pulled out damage to or destruction of the seal can occur, in particular due once again to crushing of the sealing material to be displaced.

SUMMARY OF THE INVENTION

It is an object of the invention to provide an improved electrical connector of the type identified at the outset in which the problems set out previously are eliminated in the most simple and reliable manner possible.

This task is solved according to the invention in that immediately behind and/or immediately in front of the seal viewed in the plug-in direction of the contact in each case an admission region widened transversely to the contact plug-in direction is provided for the displaced sealing material when the contact is plugged through or pulled out.

By this means the sealing material displaced when any particular electrical contact is inserted is accommodated in the rear admission region so that said material can no longer get into the chamber concerned. Accordingly, damage to the seal is ruled out. In addition, the plugging forces in the desired region are kept relatively small. By means of any particular front admission region it is also ensured that when the electrical contact is pulled out no damage to the seal occurs.

The cross-section of any particular admission region usefully increases in the direction towards the seal. Thus, with regard to the rear admission region this can possess a larger opening cross-section at its end facing towards the seal than at its end facing towards the chamber. With regard to the front admission region this can have a larger opening cross-section at its end facing towards the seal than at its other end facing, for example, towards an insertion opening.

The rear admission region viewed in the contact plug-in direction can be arranged in particular between the seal and the chamber or between the seal and the edge of the chamber on the inlet side.

The rear admission region can in particular comprise a juncture or the like. The same applies also to the front admission region. The latter can also be formed, by way of example, by means of a juncture or the like.

The rear admission region is preferably designed to be of such a size that when fitting the connector at least substantially no sealing material gets into the chamber.

The front admission region can be arranged in particular on the inside of a front face of the connector provided with at least one contact opening. The front face can be formed by way of example by an integral hinge flap or the like.

In a preferred practical embodiment of the connector according to the invention the rear admission region is bounded by two walls located opposite one another and diverging for sealing in the direction of the seal. If needs be the front admission region can be bounded by two such walls located opposite one another and diverging for sealing in the direction of the seal.

The seal can be formed by way of example by a block seal or viewed in the contact plug-in direction be divided into at least two layers or courses.

It is also particularly advantageous if the seal is divided in the region of any particular electrical contact viewed in the contact plug-in direction into at least two plug-in regions spaced apart from one another in the contact plug-in direction. If the seal as a whole is divided into at least two layers or courses the plug-in regions spaced apart from one another in the contact plug-in direction can be distributed over these layers or courses.

In a useful practical embodiment of the connector according to the invention any particular plug-in region for the associated electrical contact is provided with an opening whose maximum diameter is preferably smaller than the maximum transverse dimension of the contact in question and in particular smaller than the external diameter of the lead in question on which the contact is provided.

The invention can be used in all sealed connectors whose seal is formed by a block seal or is divided into a plurality of layers or courses.

BRIEF DESCRIPTION OF THE DRAWINGS

The invention is explained with reference to the drawing in more detail below on the basis of an exemplified embodiment. The drawings show.

DESCRIPTION OF THE PREFERRED EMBODIMENT

Figure 3:
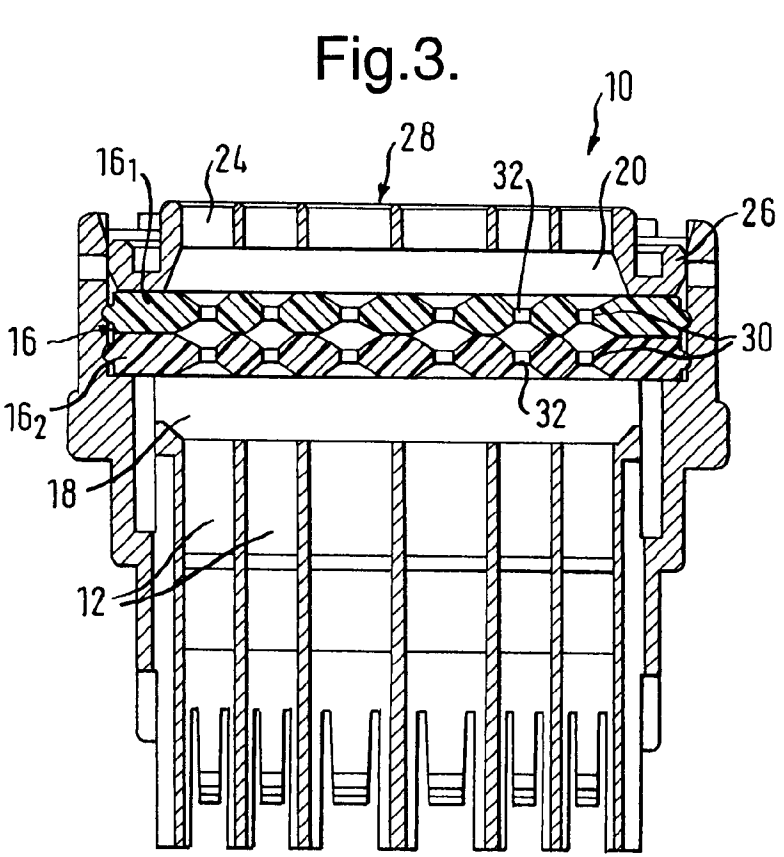
FIG. 3 is a schematic illustration in longitudinal section of the electrical connector according to FIG. 1, wherein for the sake of clarity the electrical contacts have again been left out.

FIGS. 1 to 10 illustrate an exemplified embodiment of an electrical connector 10 which may by way of example be a plug-in connector.

The electrical connector 10 comprises a plurality of chambers 12 for accommodating electrical contacts 14 and a seal 16 arranged in the inlet region of the chambers 12. When fitting the electrical connector 10 the electrical contacts 14 are plugged or pierced through this seal 16.

Immediately behind the seal 16 viewed in the contact plug-in direction KS an admission region 18 widened transversely to the contact plug-in direction KS is provided for sealing material displaced when any particular electrical contact 14 is plugged through.

Alternatively or in addition, an admission region 20 widened in each case transversely to the contact plug-in direction KS can also be provided immediately in front of the seal 16. Such a front admission region 20 serves to accommodate sealing material displaced when any particular contact 14 is pulled out.

Figure 1:
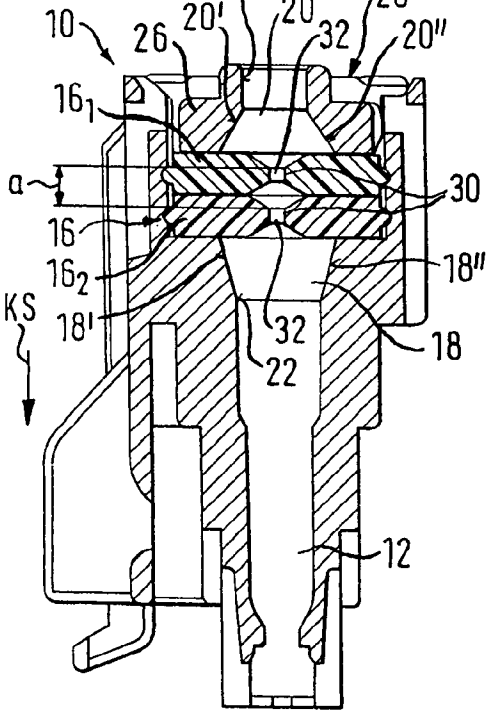
FIG. 1 is a schematic illustration in cross-section of an exemplified embodiment of an electrical connector, wherein for the sake of clarity the electrical contacts have been left out.
Figure 10:
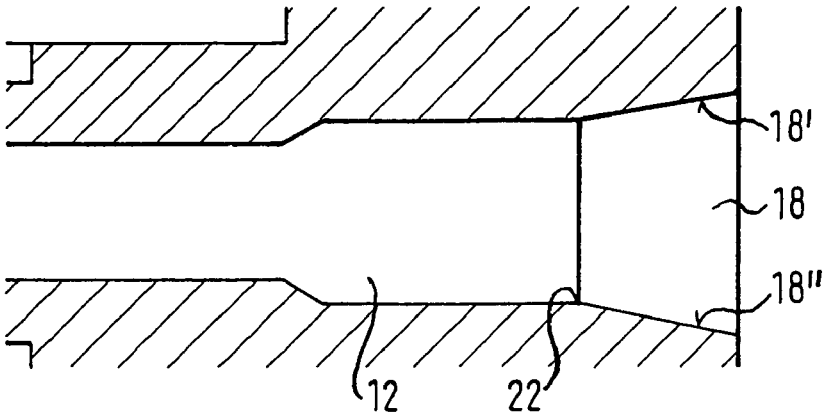
FIG. 10 is a schematic illustration in longitudinal section of a chamber of the connector according to FIG. 1 with an admission region adjoining this chamber.

As may be seen in particular in FIGS. 1, 3 and 10 the cross-section of each admission region 18, 20 increases in the direction towards the seal 16.

As may be seen in particular in FIGS. 1 and 10 each rear admission region 18 viewed in the contact plug-in direction KS is arranged between the seal 16 and the associated chamber 12 or between the seal 16 and the edge 22 of the chamber 12 on the inlet side.

The rear admission region 18 can by way of example comprise a juncture. Correspondingly the front admission region 20 may by way of example also be formed by a juncture or the like.

The rear admission region 18 is now preferably designed to be of such a size that when fitting the electrical connector 10 at least substantially no sealing material gets into the chamber 12.

The front admission region 20 is arranged on the inside of a front wall 26 of the electrical connector 10 provided with a contact opening 24. In doing this the front wall 26 may by way of example be formed by an integral hinge flap 28 or the like.

As can be best seen in FIGS. 1 and 10 the rear admission region 18 in the present case is bounded by two walls 18', 18" which are located opposite one another and diverge in the direction towards the seal 16.

Figure 4:
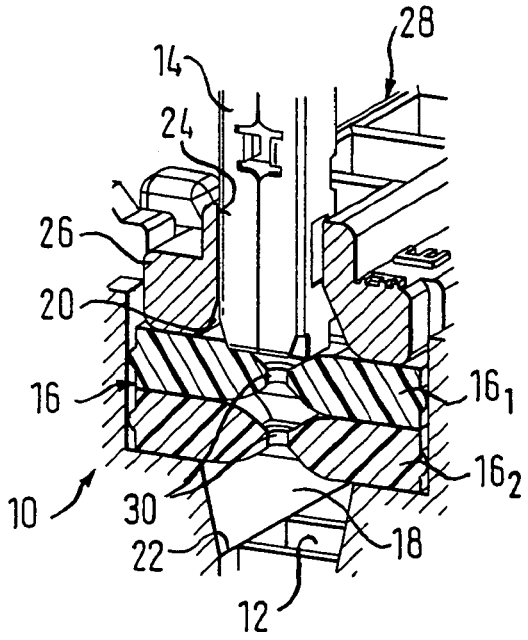
FIG. 4 is a schematic partial view in perspective of the electrical connector according to FIG. 1, wherein an electrical contact piercing through the seal is also illustrated.

In the same fashion the front admission region 20 can also be bounded by two walls 20', 20" which are located opposite one another and diverge in the direction towards the seal 16 (see in particular FIGS. 1 and 4).

The seal 16 can be formed by a block seal or viewed in the contact plug-in direction KS be divided into a plurality of layers or courses. In the present exemplified embodiment the seal 16 is divided into two such layers $\mathbf{16}_1$, $\mathbf{16}_2$ viewed in the contact plug-in direction KS (see in particular FIGS. 1, 3 and 4 to 7).

Moreover, the seal 16 can be divided in the region of any particular electrical contact 14 viewed in the contact plug-in direction KS into at least two plug-in regions 30 spaced apart from one another in the contact plug-in direction KS (see in particular FIG. 1). In the present case a division into two such plug-in regions 30 is provided.

In the present exemplified embodiment by way of example the seal 16 is divided into two layers or courses $\mathbf{16}_1$, $\mathbf{16}_2$ and the plug-in regions 30 spaced apart from one another in the contact plug-in direction KS are distributed over these layers or courses $\mathbf{16}_1$, $\mathbf{16}_2$.

Any particular plug-in region 30 can by way of example be provided with an opening 32 for the associated electrical contact 14 (see in particular FIGS. 1 and 3 to 5). The maximum diameter of such an opening 32 is preferably smaller than the maximum transverse measurement of the electrical contact 14 in question and in particular smaller than outer diameter of the lead in question on which the contact 14 is provided.

FIG. 1 shows the electrical connector 10 in a schematic cross-sectional illustration in which for the sake of clarity the electrical contacts 14 (see, for example, FIG. 2) have been left out. A corresponding electrical contact which can be inserted into the connector 10 is shown by way of example in FIG. 2.

FIG. 3 shows the electrical connector 10 schematically in longitudinal section. In this case also the electrical contacts 14 have been left out for the sake of clarity (see in particular FIG. 2 again).

Figure 2:
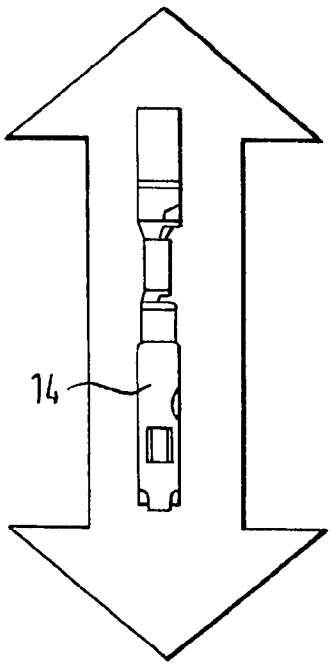
FIG. 2 is a schematic illustration of an electrical contact to be inserted into the electrical connector according to FIG. 1.

The double arrow in FIG. 2 indicates that when the electrical contact 14 is plugged in or pulled out displaced sealing material is accommodated in the rear admission region 18 or in the front admission region 20.

FIG. 4 shows a schematic partial view in perspective of the electrical connector 10, wherein an electrical contact 14 to be plugged in through the seal 16 is also shown. In this case the electrical contact 14 is pushed through the contact opening 24 of the integral hinge flap 28 only up to the seal 16 but not plugged in through the latter.

Figure 5:
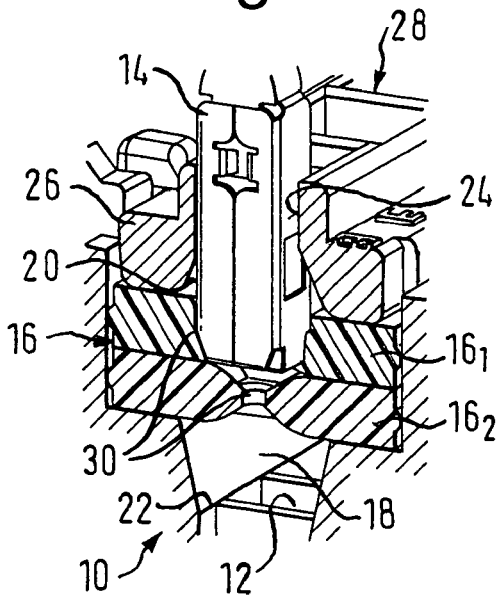
FIG. 5 is an illustration comparable to that in FIG. 4 of the electrical connector at a stage in which the electrical contact has been inserted so far that it passes through one of the two layers of the seal.

FIG. 5 shows the electrical connector 10 at a stage in which the electrical contact 14 has been inserted so fat that it passes through the first layer $\mathbf{16}_1$ of the seal 16.

Figure 6:
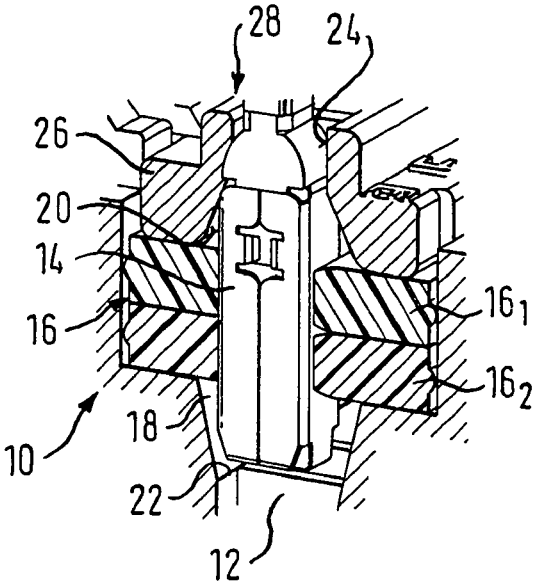
FIG. 6 is an illustration comparable to that in FIG. 4 of the electrical connector at a stage in which the electrical contact has been inserted so far that it passes through both layers of the seal.

FIG. 6 shows the electrical connector 10 at a stage in which the electrical connector 14 has been inserted so far that it passes through both layers $\mathbf{16}_1$, $\mathbf{16}_2$ of the seal 16.

Figure 7:
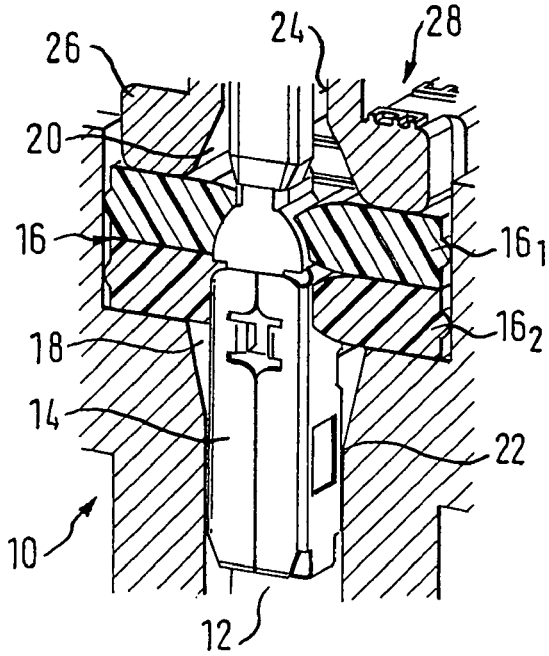
FIG. 7 is an illustration comparable to that in FIG. 4 of the electrical connector at a stage in which the electrical contact has reached its final position in which it projects by one end into the chamber in question and is surrounded in the region of its other end by the seal.

FIG. 7 shows the electrical connector 10 at a stage in which the electrical contact 14 has reached its final position in which it projects by one end into the chamber 12 in question and is surrounded in the region of its other end by the seal 16.

Figure 8:
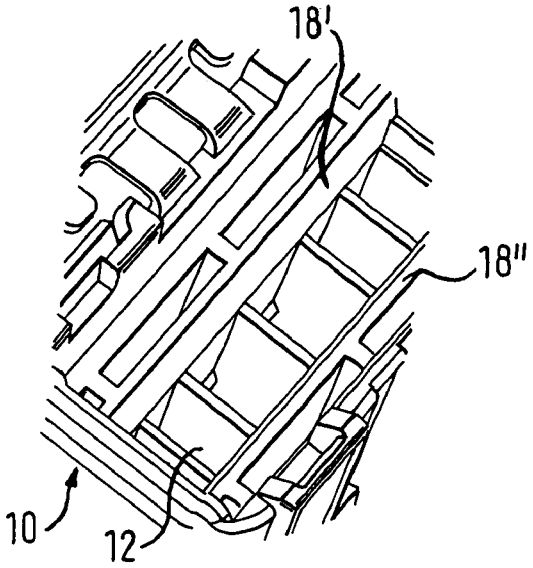
FIG. 8 is a schematic plan view of part of the electrical connector according to FIG. 1 with the integral hinge flap open, wherein for the sake of clarity the electrical contacts and the seal have been left out.

FIG. 8 shows in schematic plan view a part of the electrical connector 10 with the integral hinge flap 28 opened. In this case the electrical contacts 14 and the seal 16 are left out for the sake of clarity.

The illustration in FIG. 8 shows in particular the two walls 18', 18" located opposite one another and diverging in the direction towards the seal 16 which laterally bound the rear admission region 18.

Figure 9:
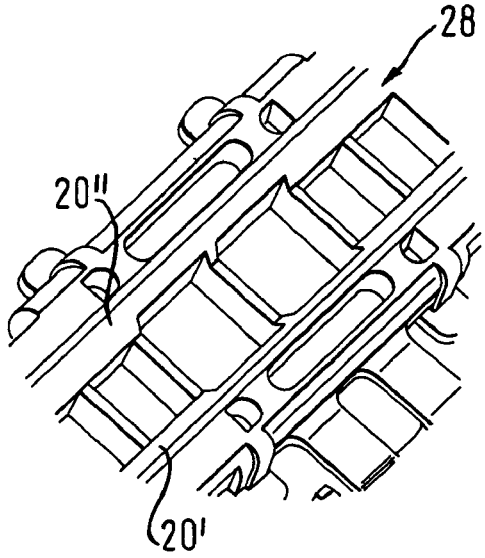
FIG. 9 is a schematic inside view of part of the integral hinge flap.

FIG. 9 shows a schematic inside view of part of the integral hinge flap 28. The illustration in FIG. 9 shows the two walls 20', 20" located opposite one another and diverging in the direction towards the seal 16 which laterally bound the front admission region 20.

FIG. 10 once again shows in longitudinal section a chamber 12 of the electrical connector 10 with a rear admission region 18 adjoining this chamber 12. In this case there is an increase in space in each chamber of approximately 20%, for example, for the sealing material displaced on inserting the electrical contact in question.

In the present case the admission regions 18, 20 have by way of example a trapezium-shaped cross-section (see, for example, FIGS. 1 and 10). As a general rule, however, the cross-section of these admission regions 18, 20 can have any other shape. Thus, for example, these regions may also be designed to be rectangular, oval, round, elliptical, etc.

LIST OF REFERENCE SYMBOLS

10 electrical connector
12 chamber
14 electrical contact
16 seal
16$_1$ layer, course
16$_2$ layer, course
18 rear admission region
18' wall
18" wall
20 front admission region
20' wall
20" edge on the inlet side
24 contact opening
26 front wall
28 integral hinge flap
30 plug-in region
32 opening
a spacing
ks contact plug-in direction

The invention claimed is:

1. Electrical connector comprising at least one chamber for accommodating at least one electrical contact and a seal arranged in the inlet region of the chamber; said seal configured to permit the electrical contact to be plugged through or pierced through when the chamber accommodates the connector, wherein, immediately behind and/or immediately in from of the seal viewed in the contact plug-in direction, the chamber comprises an admission region that is widened transversely to the contact plug-in direction so as to accommodate sealing material displaced when the contact is plugged through or pulled out of the inlet region of the chamber.

2. Connector according to claim 1, wherein the cross-section of each admission region increases in the direction towards the seal.

3. Connector according to claim 1, wherein the rear admission region viewed in the contact plug-in direction is arranged between the seal and the chamber.

4. Connector according to claim 1, wherein the rear admission region comprises a juncture.

5. Connector according to claim 1, wherein the front admission region comprises a juncture.

6. Connector according to claim 1, wherein the rear admission region is designed to be of such a size that on fitting the connector at least substantially no sealing material comes into the chamber.

7. Connector according to claim 1, wherein the front admission region is arranged on the inside of a front wall of the connector provided with at least one Contact opening.

8. Connector according to claim 7, wherein the front wall is formed by an integral hinge flap.

9. Connector according to claim 1, wherein the rear admission region is bounded by at least two opposing walls diverging in a direction towards the seal.

10. Connector according to claim 1, wherein the front admission region is bounded by at least two opposing walls diverging in a direction towards the seal.

11. Connector according to claim 1, wherein the seal comprises a block seal.

12. Connector according to claim 1, wherein, viewed in the contact plug-in direction, the seal is divided into at least two layers.

13. Connector according to claim 1, wherein, in the region of each electrical contact, the seal, viewed in the contact plug-in direction, is divided into at least two plug-in regions spaced apart from one another at a distance in the contact plug-in direction.

14. Connector according to claim 13, wherein the seal, as a whole, is divided into at least two courses or layers, and the plug-in regions spaced apart from one another at a distance in the contact plug-in direction are distributed over these courses or layers.

15. Connector according to claim 1, wherein each plug-in region for the associated electrical contact is provided with an opening whose maximum diameter is preferably smaller than the maximum transverse measurement of the contact in question and in particular is smaller than the outer diameter of the lead in question on which the contact is provided.

* * * * *